US006022134A

United States Patent [19]

Andrews

[11] Patent Number: 6,022,134

[45] Date of Patent: Feb. 8, 2000

[54] MIXING AND DISPENSING CONTAINER

[75] Inventor: Colin Lee Andrews, Clifton, United Kingdom

[73] Assignee: RXI Plastics, Inc., Los Angeles, Calif.

[21] Appl. No.: 08/999,902

[22] Filed: Oct. 24, 1997

Related U.S. Application Data

[60] Provisional application No. 60/029,465, Oct. 25, 1996.

[51] Int. Cl.[7] ..... B65D 25/08; B01F 11/00

[52] U.S. Cl. ..... 366/130; 215/DIG. 8; 215/6; 206/221

[58] Field of Search ..... 366/130; 215/DIG. 8, 215/43, 45, 265, 3, 4, 6; 220/666; 206/219, 221; 222/196.1, 202, 203

[56] References Cited

U.S. PATENT DOCUMENTS

| | | | |
|---|---|---|---|
| 98,451 | 12/1869 | Whipple | 215/3 |
| 139,905 | 6/1873 | Lyon | 215/6 |
| 1,275,315 | 8/1918 | Smith | 206/221 |
| 2,331,426 | 10/1943 | Scheemaeker | 215/DIG. 8 |
| 2,344,485 | 3/1944 | Adams | 214/45 |
| 2,533,806 | 12/1950 | Holzapfel | 206/221 |
| 2,753,990 | 7/1956 | Chalfin et al. | 215/6 |
| 2,756,129 | 7/1956 | Harris | 215/DIG. 8 |
| 2,773,591 | 12/1956 | Jensen | 206/221 |
| 2,787,268 | 4/1957 | Greenspan | 215/DIG. 8 |
| 3,089,623 | 5/1963 | Padzieski | 215/6 |
| 3,321,097 | 5/1967 | Slowey | 206/221 |
| 3,651,990 | 3/1972 | Cernei | 206/221 |
| 3,851,860 | 12/1974 | Smith | 366/130 |
| 3,924,741 | 12/1975 | Kachur et al. | 366/130 |
| 4,177,938 | 12/1979 | Brina | 215/DIG. 8 |
| 4,928,857 | 5/1990 | Ecker | 366/130 |
| 5,088,627 | 2/1992 | Musel | 206/219 |
| 5,417,321 | 5/1995 | Halm | 215/DIG. 8 |
| 5,419,429 | 5/1995 | Zimmerman et al. | 215/6 |
| 5,447,226 | 9/1995 | Laine | 206/219 |
| 5,447,245 | 9/1995 | Mehar | 215/6 |
| 5,692,945 | 12/1997 | Crowell et al. | 215/DIG. 8 |

*Primary Examiner*—Tony G. Soohoo
*Attorney, Agent, or Firm*—Darby & Darby

[57] ABSTRACT

A container comprises a flexible main chamber and a mixing chamber positioned above the main chamber and including a passage way into the main chamber. A removable plug selectively seals the passage way so that after the main chamber is filled with a first material, the plug can be inserted into the passage way and the mixing chamber filled with a second material. A cap closes the mixing chamber and selectively engages the plug so that after the cap has been placed on the mixing chamber, removal of the cap will also unseal the passageway causing the tow materials to be mixed in the main chamber. A dispensing chamber having an outlet spout is also provided in the container. A filling tube within the container connects the main chamber to the dispensing chamber.

2 Claims, 3 Drawing Sheets

MIXING AND DISPENSING CONTAINER

This application claims priority under 35 U.S.C. §119 from Provisional Application Ser. No. 60/029,465 filed Oct. 25, 1996, the entire disclosure of which is incorporated herein by reference.

BACKGROUND OF THE INVENTION

This invention relates to mixing containers. More particularly, this invention relates to a container in which two different flowable materials can be stored and transported, and thereafter mixed and dispensed in metered amounts.

In a number of situations, it is desirable to store separately two flowable materials, usually liquids, in a single container with the objective of mixing them at the time of use. For example, such containers are useful for certain types of hair tinting products and paint/adhesive mixtures. Various different container constructions have been proposed for this purpose.

The present invention provides a container which not only achieves this objective but further provides for the ability to dispense the materials in accurately metered amounts after they have been mixed.

SUMMARY OF THE INVENTION

Briefly, in accordance with the invention, the container comprises a flexible main chamber and a mixing chamber positioned above the main chamber and including a passageway into the main chamber. A removable plug selectively seals the passageway so that after the main chamber has been filled with a first material, the plug can be inserted in the passageway and the mixing chamber filled with a second material. A cap closes the mixing chamber and includes means for selectively engaging the plug so that after the cap has been placed on the mixing chamber, removal of the cap will also unseal the passageway causing the two materials to be mixed in the main chamber. A dispensing chamber having an outlet spout is also provided in the container. A filling tube within the container connects the main chamber to the dispensing chamber. When it is desired to dispense a liquid, pressure is applied to the flexible main chamber causing the material to flow through the filling tube into the dispensing chamber. The dispensing chamber may be metered so that, when desired, a precise amount of the mixed material can be discharged from the dispensing chamber.

THE DRAWINGS

DETAILED DESCRIPTION

Figure 1:
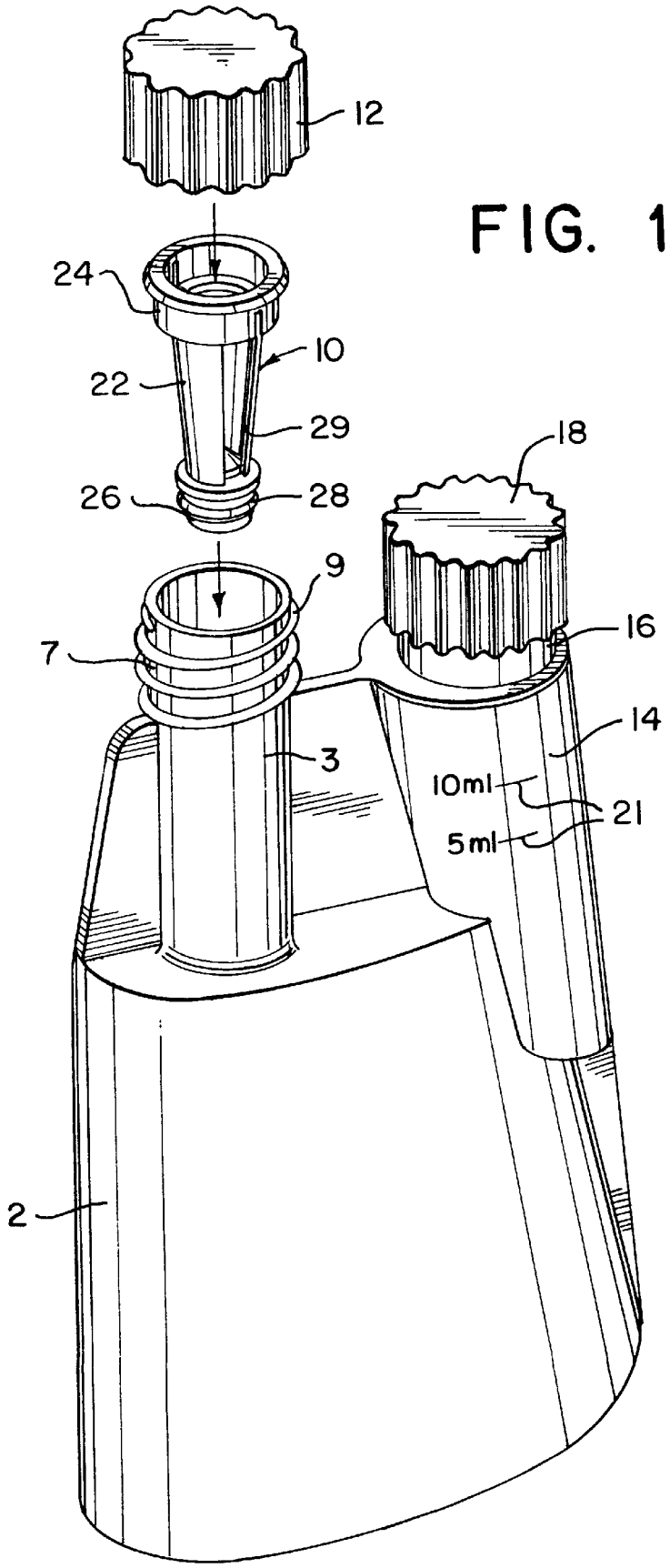
FIG. 1 is a perspective view showing the separate elements of the invention.
Figure 2:
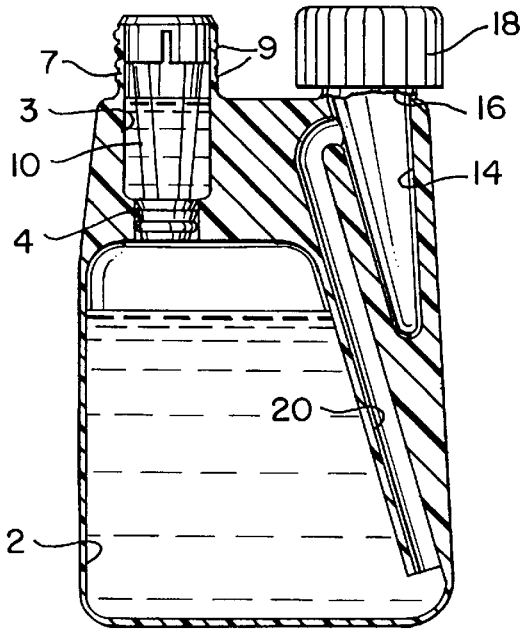
FIG. 2 is a side sectional view of the container of FIG. 1 showing liquid contained in both the main and mixing chambers.
Figure 2A:
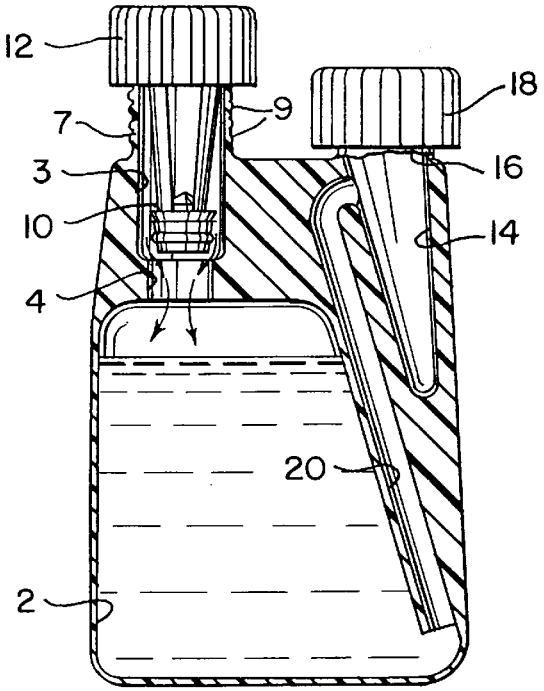
FIG. 2A is a side sectional view showing the cap of the mixing chamber removed.
Figure 2B:
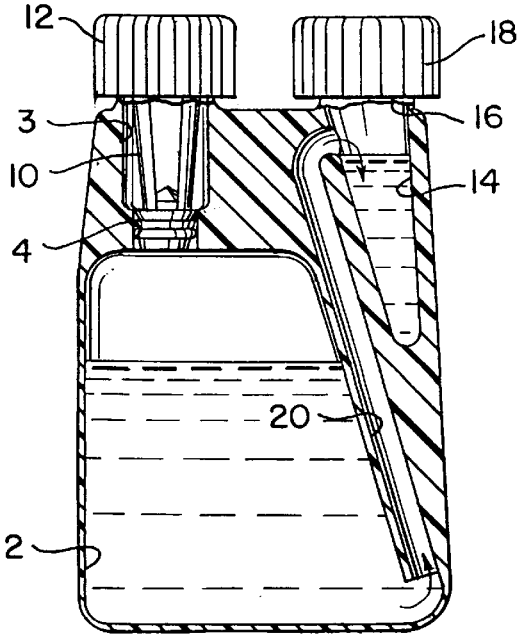
FIG. 2B is a side sectional view of the container after some of the mixed liquid has been transferred to the dispensing chamber.

Referring to FIGS. 1 and 2 of the drawings, a container according to the invention comprises a main chamber 2 above which a smaller storage chamber 3 is positioned. A passageway 4 between chambers 3 and 2 permits material in chamber 3 to drop into the main chamber 2 when the materials are to be mixed. By way of example only, the container may be blow molded from any suitable polymer with main chamber 2 being sufficiently flexible so that its contents can be forced into a dispensing chamber as described below.

Mixing chamber 3 includes a neck 7 which has external threads 9. A plug 10, described in detail below, selectively seals the passageway 4. A cap 12 closes and seals the mixing chamber 3 and, also as described below, selectively engages plug 10 so that passageway 4 can be opened when it is desired to mix the contents of the chambers 3 and 2.

The invention also includes a dispensing chamber 14 positioned above and to the side of the main chamber 2. The dispensing chamber 14 includes a pouring spout 16 which can be closed and sealed by a cap 18. A filling tube 20 is connected between the lower portion of the main chamber 2 and the upper portion of the dispensing chamber 14 and permits a portion of the contents of the main chamber 2 to be transferred to the dispensing chamber 14 when it is desired to dispense the mixed materials. Preferably, the dispensing chamber contains indicia 21 so that a precisely metered amount of material can be transferred into the dispensing chamber 14.

The construction of the plug 10 is best shown best in FIGS. 3–7.

Figure 3:
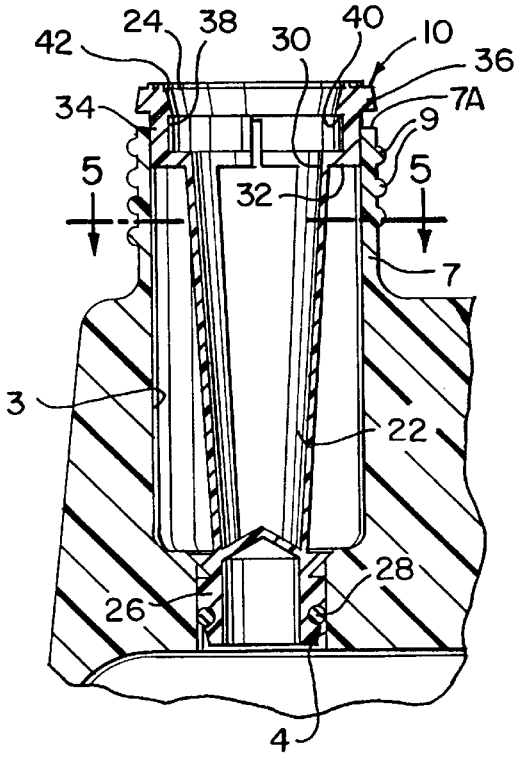
FIG. 3 is a side sectional view showing the construction of the plug used to seal the dispensing chamber.
Figure 4:
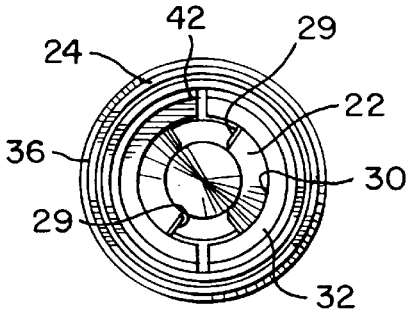
FIG. 4 is a top view of the plug.
Figure 5:
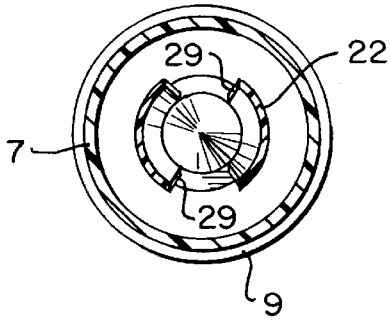
FIG. 5 is a top sectional view along the line 5—5 FIG. 3.
Figure 6:
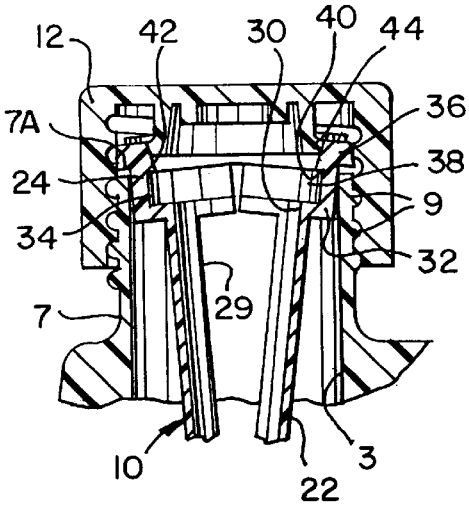
FIG. 6 is a side sectional view showing how the cap of the dispensing chamber engages the plug.
Figure 7:
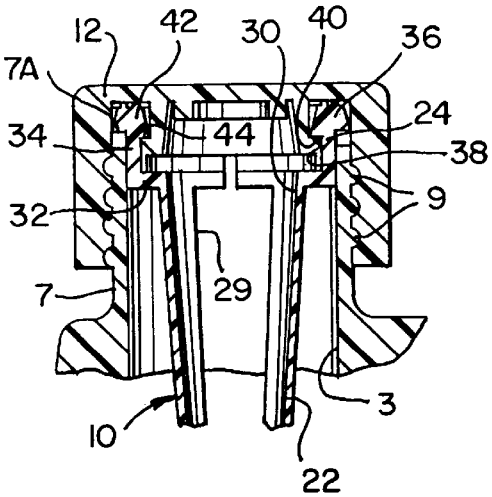
FIG. 7 shows the cap of the dispensing chamber and plug after they have been interconnected.

Plug 10 comprises a hollow frusto-conical portion 22 extending downwardly from a cup-shaped portion 24 and is closed at its lower end by a bung portion 26. A resilient O-ring 28 is retained within a suitable groove (not numbered) within the bung portion 26 so that when the plug 10 is inserted into the mixing chamber 3, the passageway 4 is closed (FIG. 3).

Portion 22 includes two longitudinally slots 29 communicating with cup portion 24 through orifice 30 formed in the base 32 thereof. Cup portion 24 includes wall 34 extending upwardly from base 32 and having a flange 36 extending outwardly from the top, the lower face of flange 36 engaging the top edge 7A of neck 7.

A recess 38 is contained within the inner side of wall 34 and is defined by base 32 and inwardly directed annular shoulder 40, the upper inner side 42 of wall 34 above shoulder 40 being outwardly flared.

The overall length of plug 10 is such that flange 36 engages edge 7A of neck 7 when bung 26 fully closes passageway 4.

Cap 12 is internally threaded for engagement with threads 9 of neck 7. outwardly flared annular member 42 extends downwardly from the inner top portion of the cap into cup portion 24 of plug 10 and includes an outwardly directed flange 44 extending from its end for engagement in recess 38 of portion 24. The positioning and dimensioning of annulus 42 and flange 44 is such that with flange 44 engaging in plug recess 38 the lower face of flange 44 engages the base 32 of cup 24 and the top surface of flange 36 of cup portion 24 engages the underside of the top of cap 12 to provide a fluid-tight seal therebetween when cap 12 is screwed down onto neck 7.

In use, a first liquid is introduced into chamber 2 via chamber 3 and passageway 4. Plug 10 is then inserted through neck 7 and bung 26 is engaged in passageway 4 in order that 0-Ring 28 provides a fluid-tight seal, the underside of flange 36 engaging the top edge 7A of neck 7. A second liquid is then introduced through cup portion 24 into chamber 3 via elongate slots 29 in the walls of plug portion 22. Cap 12 is then screwed down onto neck 7, annular member 42 and flange 44 being forced inwardly by the outwardly flared surface 42 of cup 24 until the flange 44 clips into the recess 38 in wall 34 of cup 24. Cap 12 is screwed down sufficiently firmly to ensure a fluid tight seal between the top 7A of neck 7, flange 36 of cup 24 and the underside of the top of cap 12.

When it is desired to mix the liquids from chambers 2 and 3, cap 12 is partially unscrewed from neck 7, thereby raising bung 26 to allow liquid from chamber 3 to pass into chamber 2 and to be mixed with the liquid contained therein. Cap 12 may then be screwed back down onto neck 7 and the container shaken to thoroughly mix the two liquids.

When it is desired to dispense the mixed liquids, cap 18 is unscrewed so that the airtight seal is broken and fluid can be transferred from the chamber 2 into dispensing chamber 14. Pressure is applied to the flexible main chamber 2 causing the mixed liquid within the main chamber 2 to flow through filling tube 20 into the dispensing chamber 14. Because of the visible gradations 21 appearing on the dispensing chamber 14, the user may fill the dispensing chamber with a precise amount of mixed liquid. Pressure is then removed from the main chamber and the liquid to be dispensed is left within the chamber 14 so that it can be poured through spout 16 after removal of cap 18.

I claim:

1. A container for mixing two flowable materials and dispensing a material amount of the mixed materials, comprising a flexible main chamber, a mixing chamber above said main chamber including a passageway into the main chamber, a removable plug for selectively sealing said passageway, a first cap for closing said mixing chamber, said first cap and plug having means for selectively connecting them together, whereby removal of the cap from the mixing chamber removes the plug from the passageway to permit material to flow from the mixing chamber into the main chamber, a dispensing chamber having an outlet spout and a cap for closing said outlet spout, and a filler tube connecting the main chamber to said dispensing chamber, whereby pressure applied to said main chamber forces material from said main chamber to said dispensing chamber.

2. A container according to claim 1, wherein said filler tube connects the bottom of the main chamber to the upper portion of said dispensing chamber.

* * * * *